United States Patent [19]

Pothier

[11] Patent Number: 4,562,440

[45] Date of Patent: Dec. 31, 1985

[54] ANTENNA COUPLER WITH RIBBON GASKET

[75] Inventor: Robert G. Pothier, Amherst, N.H.

[73] Assignee: Sanders Associates, Inc., Nashua, N.H.

[21] Appl. No.: 564,663

[22] Filed: Dec. 23, 1983

[51] Int. Cl.[4] ..... H01Q 1/28

[52] U.S. Cl. ..... 343/703; 343/705

[58] Field of Search ..... 343/703, 705, 708, 872

[56] References Cited

U.S. PATENT DOCUMENTS 4,134,119 1/1979 Sanoz et al. ..... 343/703

*Primary Examiner*—Eli Lieberman

*Attorney, Agent, or Firm*—Louis Etlinger; Stanton D. Weinstein

[57] ABSTRACT

The method of repeatably making an antenna coupler for holding a test antenna in a repeatable fixed position on the exterior surface of an aircraft or the like relative to a working antenna disposed within the aircraft. A positive mold is made of the area adjacent the antenna within the aircraft. A temporary RF shielding box is placed over the positive mold and the mold is modified to support the box repeatably in a fixed position. Pins are provided to interact with mounting holes for an antenna. A permanent box to be used as part of the coupler is mounted on the positive mold. A ribbon gasket comprising a plurality of tubular, compressible members of an RF shielding material and having mounting tabs along the length thereof is disposed against the surface of the mold about the peripheral edge. The gasket and the box are interconnected by an epoxy material, including RF shielding means. The coupler is removed from the mold and the antenna is mounted to the mounting holes. Offsetting shrinkage materials are employed in the various molding steps to minimize size deviations.

6 Claims, 15 Drawing Figures

ANTENNA COUPLER WITH RIBBON GASKET

BACKGROUND OF THE INVENTION

The present invention relates to antenna couplers and, more particularly, to a method and construction for making an antenna coupler adapted to releasably mate with the skin of an aircraft adjacent an antenna to be tested.

A prior art approach to an antenna coupler is shown in simplified form in FIG. 1. The problem to be solved is the positioning of a test antenna 10 adjacent a working antenna 12 disposed within a housing 14 in the skin 16 of an aircraft, generally indicated as 18. The prior approach is to place the test antenna 10 within an RF shielding metal coupling enclosure, indicated by the dotted line 20, adapted to fit tightly against the skin 16 of the aircraft 18 around the housing 14. Such coupling enclosures generally work for their intended purpose but are difficult and costly to manufacture if the periphery, indicated as 22, is to tightly seal completely against the skin 16 of the aircraft 18 so as to prohibit the entry and escape of RF energy, as indicated by the arrows 24. The skin 16 of the aircraft 18 around the housing 14 is typically of a complex three-dimensional shape such that the peripheral edge 22 of the coupling enclosure 20 can only be formed for a tight fit by complex and costly manual or numerical control machining processes.

Wherefore, it is the object of the present invention to provide an antenna coupler affording complete RF shielding and sealing which is simple and economical to manufacture.

SUMMARY

The foregoing objective has been met by the method of the present invention for making an antenna coupler for holding a test antenna in a fixed position on the exterior surface of a structure such as an airplane relative to a working antenna disposed within the structure comprising the steps of, making a negative mold of the structure adjacent the working antenna; using the negative mold to make a positive mold of the structure adjacent the working antenna; attaching releasable support members to the positive mold; attaching a temporary support structure to the support members; connecting repositioning members to the positive mold for allowing the support structure to be repeatably removed and replaced in the same position on the positive mold; replacing the temporary support structure with a permanent support structure having antenna mounting means and having the same configuration as the temporary support structure with respect to the support members whereby the permanent support structure is placed in the same positional relationship on the positive mold as the temporary support structure and the antenna mounting means is placed in a position to hold the test antenna in the fixed position, the support structure having a bottom peripheral edge positioned in spaced relationship to the surface of the positive mold; disposing a ribbon gasket for shielding RF energy in conformity with the surface of the positive mold adjacent the spaced bottom peripheral edge of the permanent support structure; permanently interconnecting the ribbon gasket and the bottom peripheral edge with a resilient material having RF attenuation capability to form the antenna coupler; removing the antenna coupler comprising the combined permanent support member, interconnecting material, and ribbon gasket from the positive mold; and, attaching the test antenna to the antenna mounting means.

To maintain close tolerances, molding materials having positive and negative shrinkage factors are alternately used in the molding steps, i.e., epoxy and plaster.

In the preferred embodiment, the ribbon gasket is formed by embedding an elongated deformable member with an elongated connector tab or fin in a material having the molding qualities of beeswax with the connector tab exposed. The ribbon gasket and wax can then be bent to conform tightly to the surface of the aircraft, or the like, and the gasket interconnected by embedding the connector tab which runs along the length of the deformable member into the resilient material. The beeswax-like material is then removed to expose the elongated deformable member which then lies tightly against the skin of the aircraft, or the like, when the antenna coupler is placed in position.

DESCRIPTION OF THE PREFERRED EMBODIMENT

Figure 1:
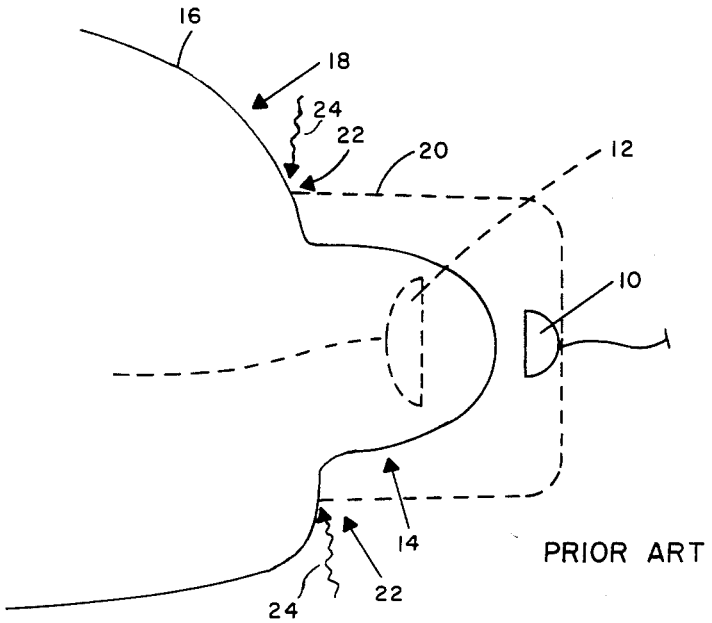
FIG. 1 is a simplified drawing through an antenna and antenna coupler for an aircraft according to the prior art.
Figure 2:
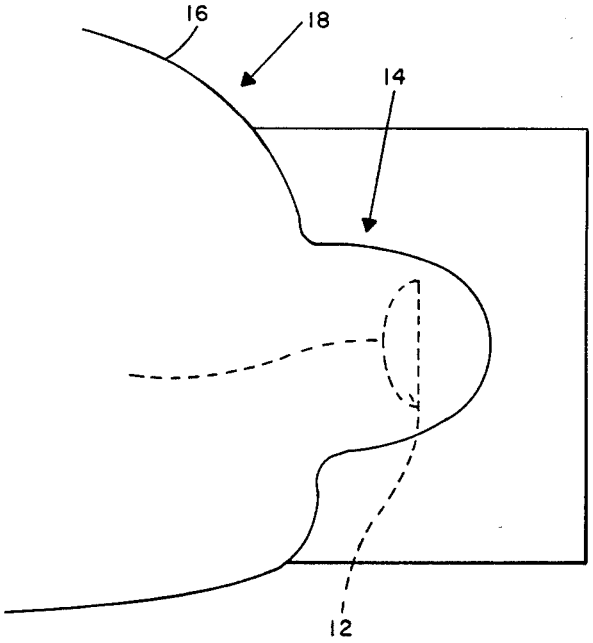
FIGS. 2–11 are simplified, cutaway elevation drawings showing the steps of making an antenna coupler according to the present invention.
Figure 3:
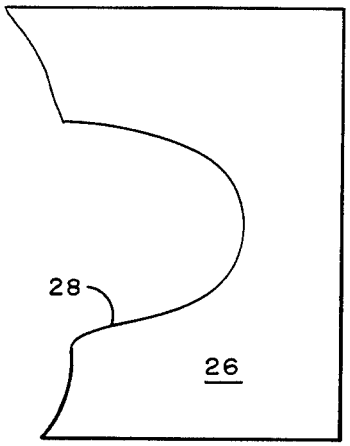
Figure 4:
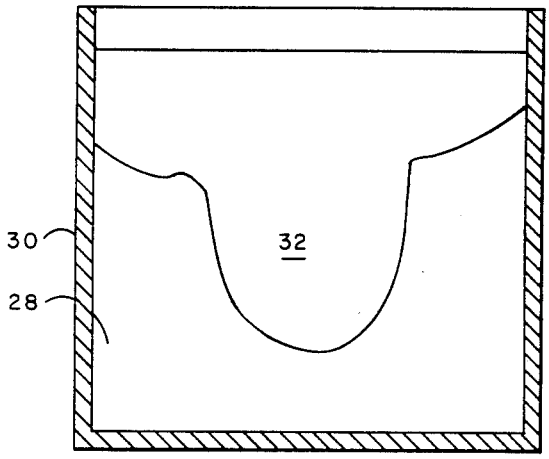
Figure 5:
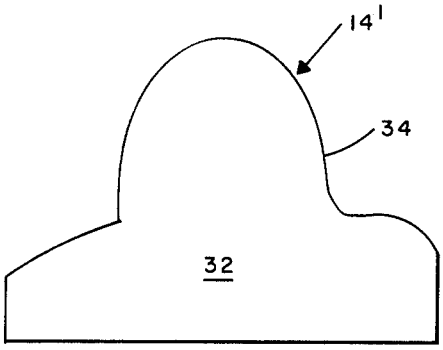

Turning first to FIG. 2, the first step in making an enclosure according to the present invention is shown. Releasable molding material 26 is placed about the housing 14 and against the skin 16 of the aircraft 18. When hardened, the molding material 26 is removed to provide a negative mold 28 of the housing portion 14 and aircraft skin 16 of the aircraft 18 adjacent the working antenna 12 as shown in FIG. 3. As shown in FIG. 4, the negative mold 28 is placed in a container 30 and filled with a second releasable molding material 32 which, when hardened and released, provides a positive mold 34 of the housing 14 and adjacent area of the aircraft 18 as shown in FIG. 5.

Figure 6:
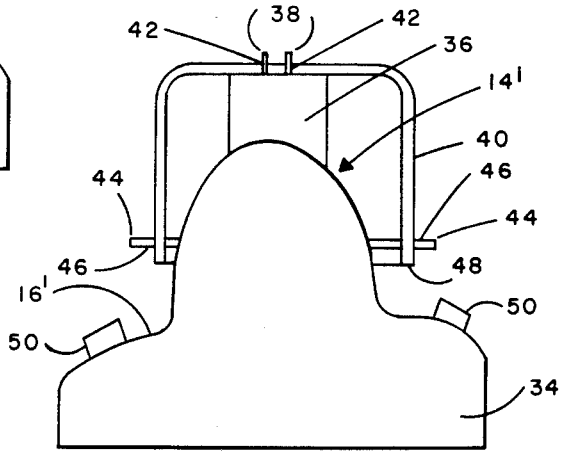

Turning now to FIG. 6, a support member 36 is positioned on the outer end of the housing 14' of the positive mold 34 generally in the same position as the test antenna 10 is desired. The support member 36 has alignment pins 38 in the same position as the mounting holes for the test antenna 10 will occupy. A temporary support structure in the form of a drawn metal box 40 having first holes 42 therein is placed over the housing 14' with the alignment pins 38 disposed in the first holes 42. Removeable pins 44 are disposed through second holes 46 in the box 40 and into holes (not shown) in the positive mold 34 provided therefor to support and hold the box 40 in proper positional alignment. Note that the bottom peripheral edge 48 of the box 40 is in spaced relationship to the "skin" 16' of the positive mold 34 but is not critical as to its actual position since it is cast in plastic in later steps. A spacer member 50 is disposed peripherally about the entire edge 48 spaced therefrom and in contact with the skin 16' of the positive mold 34.

The function of the spacer member 50 will become apparent shortly.

Figure 7:
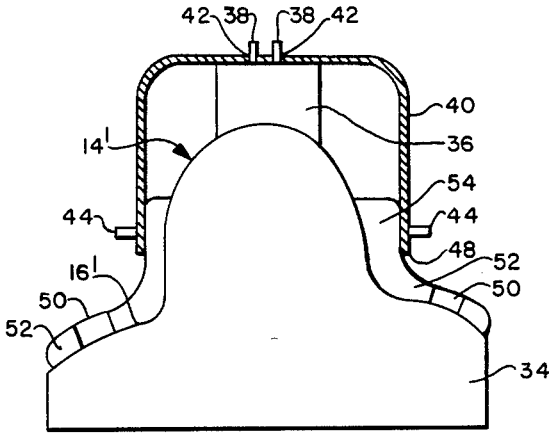
Figure 8:
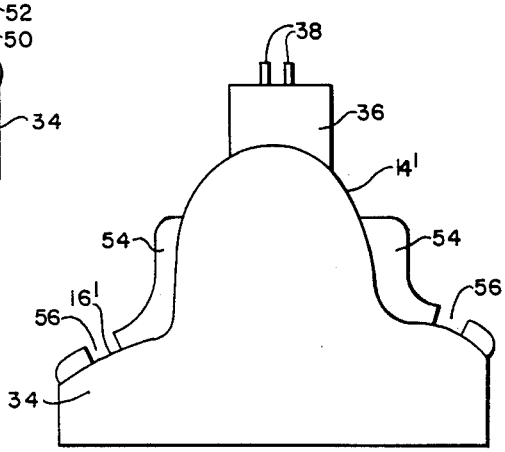

Turning now to FIG. 7, with the box or temporary support structure 40 held in position by the support members 36 and removeable pins 44 (which also act as support members), additional molding material 52 is added to the positive mold 34 around the spacer member 50 and up into the space between the bottom peripheral edge 48 of box 40 and the housing 14' portion of the positive mold 34 so as to form repositioning members 54 on the positive mold such that when the pins 44 are removed and the box 40 (or a permanent equivalent thereof as will be seen shortly) is removed, it can be slid back over the repositioning members 54 into exactly the same position as it previously occupied. The spacer member 50 is then removed so as to provide a peripheral channel 56.

Figure 9:
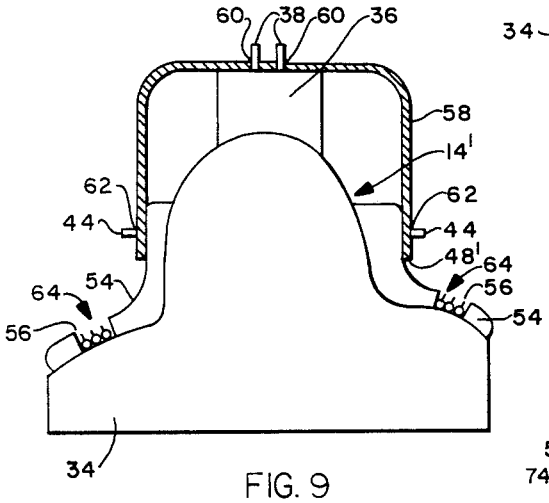
Figure 13:
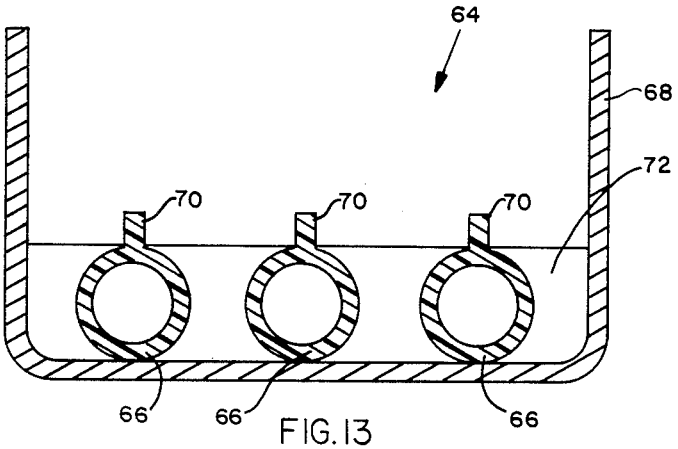
FIGS. 13–15 show the details of preparation, incorporation, and use of the ribbon gasket in the coupler of the present invention in simplified cross-section.
Figure 14:
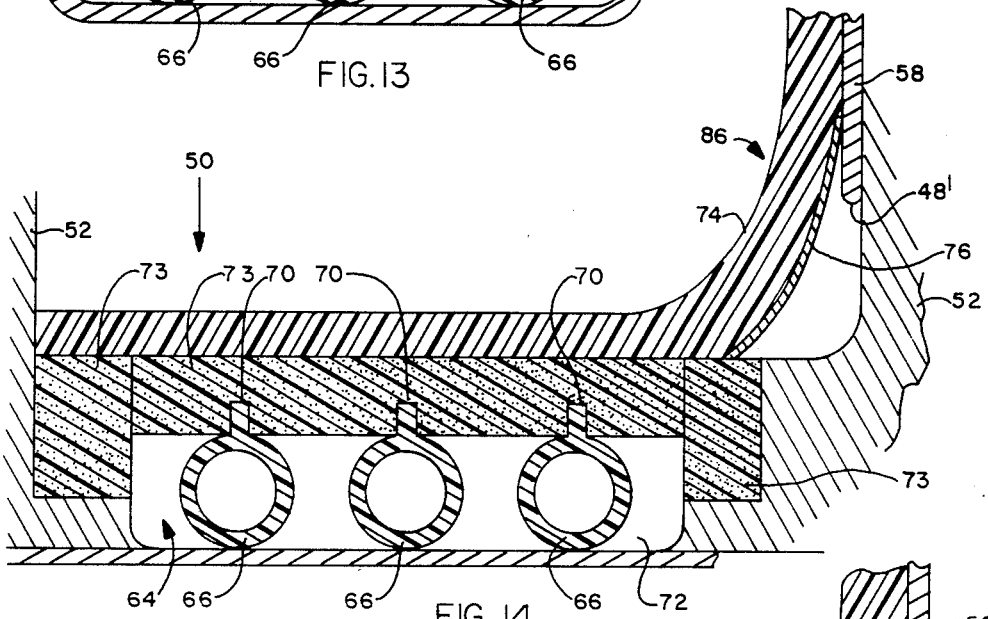
Figure 15:
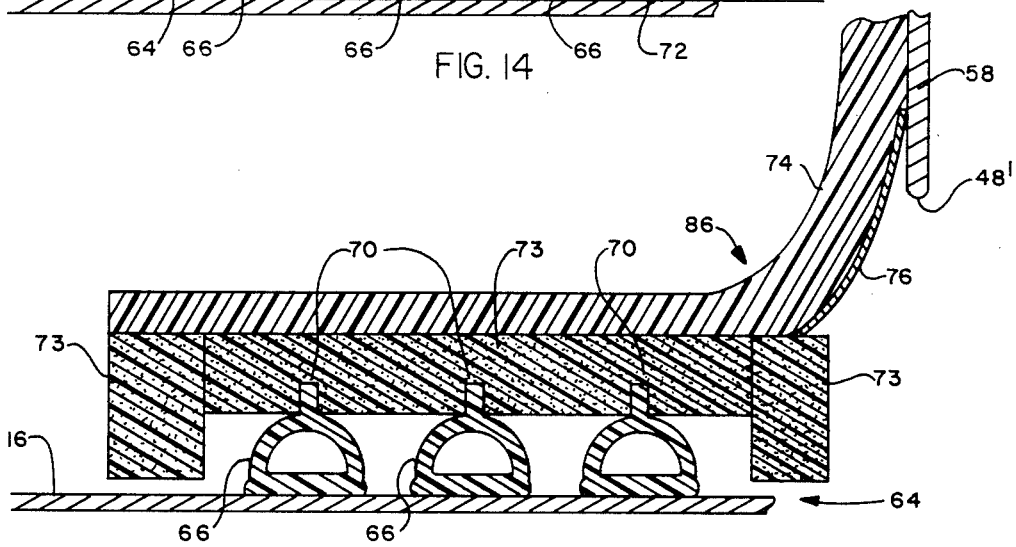

Turning now to FIG. 9, a permanent support member in the form of a drawn metal box 58 is positioned over the repositioning members 54 with holes 60 therein (to be used later for the mounting of a test antenna 10) disposed over the alignment pins 38. The removeable pins 44 are disposed in holes 62 also provided therefor. The components for a ring gasket, generally indicated as 64, are disposed against the skin 16' and in conformity therewith within the peripheral channel 56 about the periphery of the bottom peripheral edge 48' of the box 58. The manner of preparation and incorporation of the ring gasket 64 can best be understood with reference to the enlarged drawings of FIGS. 13–15. A plurality of elongated compressible members 66 are placed within a flat bottomed container 68. The compressible members 66 include material to make them RF absorbable in a manner well known to those skilled in the art and they each have a tab or fin 70 extending therefrom along the length thereof. While a continuous fin 70 is preferred, a plurality of discontinuous tabs could be employed as well. The members 66 and fins 70 can be conveniently manufactured as a ferrite loaded silicone elastomer extrusion. The elongated compressible members 66 are positioned in the container 68 and a beeswax material 72, or the like, is poured into the container 68 to cover the members 66, but leave the longitudinal fin 70 exposed as shown in FIG. 13. The combination of the members 66 and wax 72 is removed from the container 68. The wax 72 is chosen to be of a quality like beeswax so that it is moldable under room temperature conditions. The wax 72 containing the members 66 is placed within the peripheral channel 56 and molded against the skin 16' to conform to the surface thereof. That is the position represented by FIG. 9. The two ends of the respective members 66 butt against each other to make each member 66 a closed loop within the channel 56. The balance of the channel is filled with an RF shielding metal loaded resilient plastic 73 in a manner well known in the art, such as with an epoxy, polyurethane, or the like, containing metal particles therein. Portions of the plastic 73 can comprise pre-molded stock; but, the center portion must be cast in place to encase and hold the tabs or fins 70 embedded therein as shown in FIG. 14. The ring gasket 64, therefore, comprises the members 66 and the surrounding RF shielding plastic 73. Note that the plastic 73 extends down around the sides of the outermost members 66 so that (as shown in FIG. 15) when the members 66 are compressed against the skin 16 of an airplane 18, there is only a slight gap between the bottom of the plastic 73 and the skin 16. If desired, a flat ferrite gasket can be embedded within the plastic 73 in addition. As an alternative, although not preferred, a flat ferrite gasket can be used in lieu of the members 66.

Figure 10:
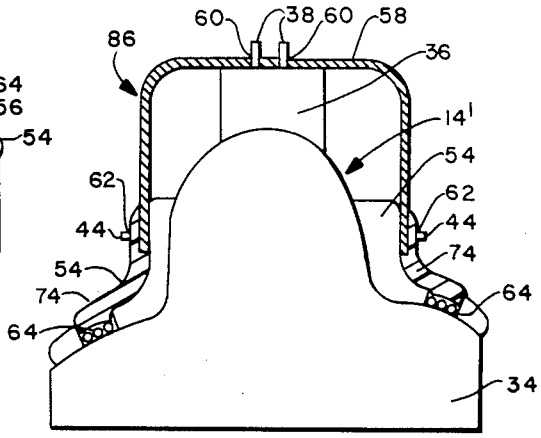
Figure 11:
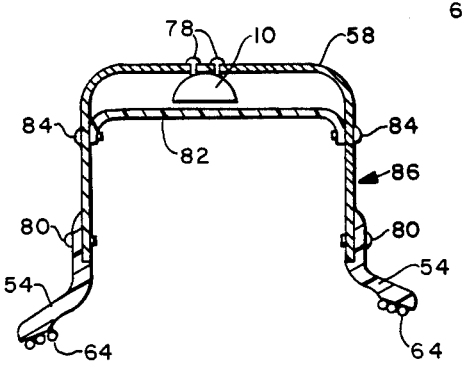
Figure 12:
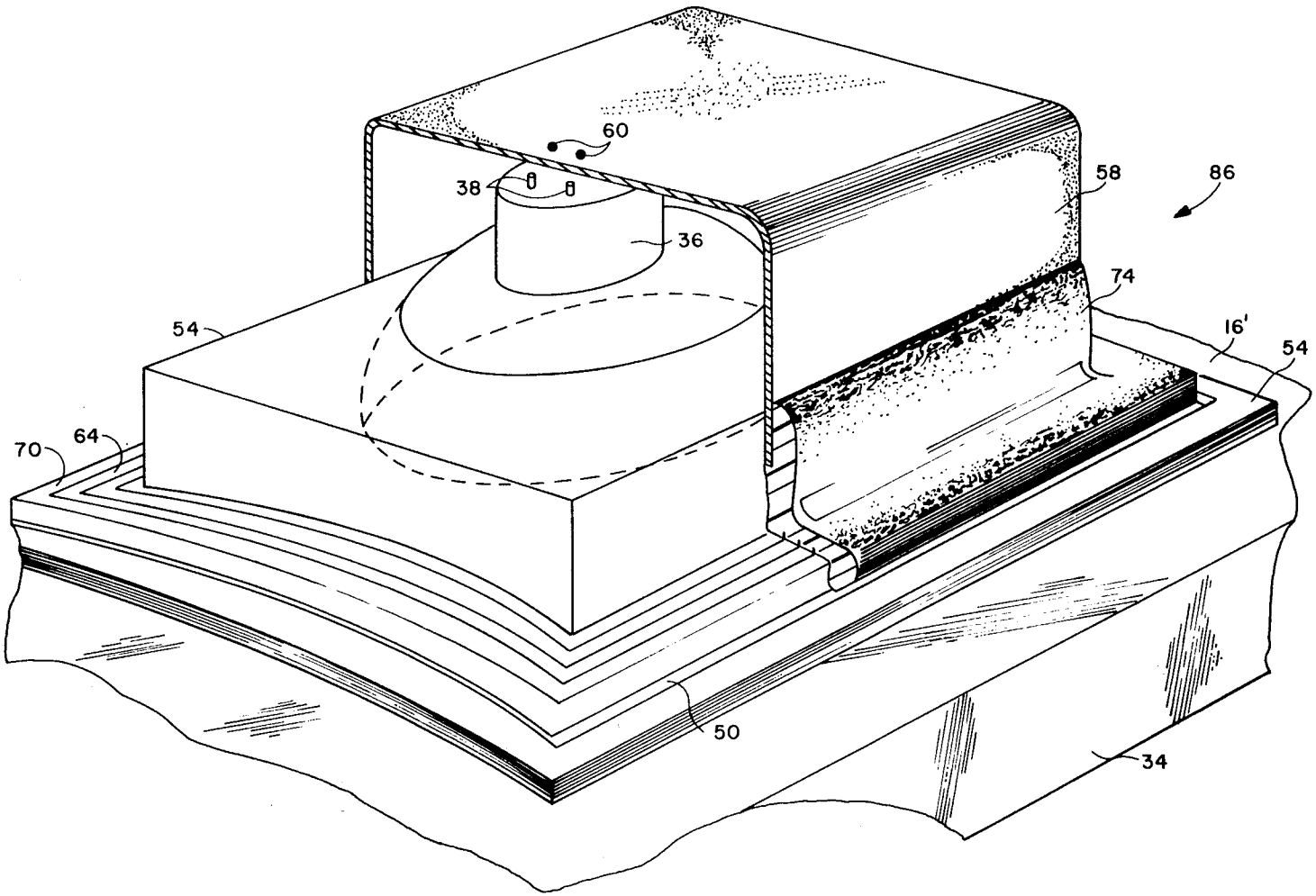
FIG. 12 is a perspective, partially cutaway drawing showing the coupler of the present invention prior to its removal from the mold.

As shown in FIGS. 10 and 14, the ring gasket 64 and box 58 are then interconnected with a resilient material 74 to form the coupler 86. This can be accomplished, again, by the use of an epoxy, polyurethane, or the like, containing fiberglass strands therein as is well known in the art for strength purposes. The interconnecting material 74 adheres to the plastic 73 on one side and extends up over the removeable pins 44 and adheres to the surface of the box 58 on the other side. It is preferred that a metal foil 76, or the like, additionally be added to bridge the space between the ring gasket 64 and box 58 with additional RF shielding capability as shown in FIG. 14. With the interconnecting material 74 in place, the assembly procedure appears as in FIGS. 10 and 12.

An important aspect of the present invention is performing the successive molding steps in a manner which tends to eliminate sizing errors. The successive molding steps employ molding materials which, alternately, have positive and negative shrinkage factors approximately equal such that sizing errors tend to be self-cancelling. In the tested embodiments, plaster (i.e., gypsum) and epoxy were alternately used. The plaster tends to expand, while the epoxy tends to shrink. Thus, to accomplish the above-described procedure with minimum size distortion, the negative mold 28 is made with plaster. The positive mold 34 is then made with epoxy. The material added to the positive mold 34 to form the repositioning members 54 is of plaster once again. Finally, the plastic 73 and interconnecting material 74 are of epoxy which results in an equal number of positive and negative shrinkage factors such that the resultant sizings should have the closest tolerances possible.

Finally, the coupler 86, comprising the box 58, the interconnecting material 74, and the ring gasket 64 is removed from the positive mold 34. The test antenna 10 is attached by rivets 78, or the like, through the holes 60 in the box 58 provided therefor. The removeable pins 44 are replaced with rivets 80, or the like, to securely hold the interconnecting material 74 to the box 58. The wax 72 is removed (as by heating) to expose the compressible members 66. Preferably, a boot 82 of polypropylene, or the like, is attached to the inside of the box 58 adjacent the antenna 10 with rivets 84, or the like, in order to protect the antenna 10 from the elements. As shown in FIG. 15, when the antenna coupler 86 of the present invention is placed over the housing 14 of an aircraft 18, the compressible members 66 of the ring gasket 64 are compressed tightly against the skin 16 of the aircraft as shown in FIG. 15 to effect a tight RF shield around the edge of the coupler 86.

Wherefore, thus having thus described my invention, I claim:

1. The method of making an antenna coupler for holding a test antenna in a fixed position on the exterior surface of a structure relative to a working antenna disposed within the structure comprising the steps of:

(a) making a negative mold of the structure adjacent the working antenna;

(b) using the negative mold to make a positive mold of the structure adjacent the working antenna;

(c) attaching releasable support members to the positive mold;

(d) attaching a temporary support structure to the support member;

(e) connecting repositioning members to the positive mold for allowing the support structure to be repeatably removed and replaced in the same position on the positive mold;

(f) replacing the temporary support structure with a permanent support structure having antenna mounting means and having the same configuration as the temporary support structure with respect to the support members whereby the permanent support structure is placed in the same positional relationship on the positive mold as the temporary support structure and the antenna mounting means is placed in a position to hold the test antenna in the fixed position, the support structure having a bottom peripheral edge positioned in spaced relationship to the surface of the positive mold;

(g) disposing a ribbon gasket for shielding RF energy in conformity with the surface of the positive mold adjacent the spaced bottom peripheral edge of the permanent support structure;

(h) permanently interconnecting the ribbon gasket and the bottom peripheral edge with a resilient material having RF attenuation capability to form the antenna coupler;

(i) removing the antenna coupler comprising the combined permanent support member, interconnecting material, and ribbon gasket from the positive mold; and, (j) attaching the test antenna to the antenna mounting means.

2. The method of claim 1 and additionally comprising the steps of:

(f1) before step (g), forming the ribbon gasket by embedding an elongated deformable member with a connector tab in a material having the molding qualities of beeswax with the connector tab exposed;

(h1) interconnecting the ribbon gasket by embedding the connector tab into the resilient material; and, (h2) thereafter removing the beeswax-like material to expose the elongated deformable member.

3. The method of claim 1 wherein:

steps (a) and (c) thereof are accomplished using a material having a negative shrinkage factor and steps (b) and (h) thereof are accomplished using a material having a positive shrinkage factor whereby size deviations are minimized.

4. The method of claim 1 wherein:

steps (a) and (c) thereof are accomplished using a plaster material and steps (b) and (h) thereof are accomplished using an epoxy material whereby the shrinkage factors of the materials in alternate molding procedures are offsetting the size deviations are minimized.

5. The method of claim 2 wherein step (h1) thereof comprises the steps of:

(h1a) forming a channel on the surface of the positive mold disposed about the bottom peripheral edge of the permanent support structure;

(h1b) disposing the deformable member and beeswax-like material in the channel in conformity with the surface of the positive mold;

(h1c) molding a first epoxy material having metal particles therein in the channel with the connector tab therein; and, (h1d) molding a second epoxy material between the first epoxy material and the bottom peripheral edge of the permanent support structure.

6. The method of claim 5 wherein:

after step (hlc) and before step (hld) a metal foil is disposed to bridge the space between the first epoxy material and the bottom peripheral edge of the permanent support structure.

* * * * *